US008991603B2

(12) United States Patent
Hession

(10) Patent No.: US 8,991,603 B2
(45) **Date of Patent: *Mar. 31, 2015**

(54) SLIDE CARD FOR SELECTIVE INSERTION AND WITHDRAWAL FROM A SLEEVE

(71) Applicant: MeadWestvaco Corporation, Richmond, VA (US)

(72) Inventor: Christopher J. Hession, Mechanicsville, VA (US)

(73) Assignee: MeadWestvaco Corporation, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/043,002

(22) Filed: Oct. 1, 2013

(65) Prior Publication Data

US 2014/0027340 A1 Jan. 30, 2014

Related U.S. Application Data

(63) Continuation of application No. 13/412,993, filed on Mar. 6, 2012, now Pat. No. 8,561,798, which is a continuation of application No. 11/576,958, filed as application No. PCT/US2005/036312 on Oct. 11, 2005, now Pat. No. 8,132,671.

(60) Provisional application No. 60/617,982, filed on Oct. 11, 2004.

(51) Int. Cl.

| | |
|---|---|
| ***B65D 5/38*** | (2006.01) |
| ***B65D 83/00*** | (2006.01) |
| ***B65D 83/04*** | (2006.01) |

(52) U.S. Cl.

CPC ..... *B65D 83/0088* (2013.01); *B65D 5/38* (2013.01); *B65D 83/0463* (2013.01); *B65D 2215/04* (2013.01); *B65D 2583/0454* (2013.01)

USPC ..... 206/470

(58) Field of Classification Search

USPC ..... 206/470, 531, 532, 534.1, 534.2, 536, 206/538, 539

See application file for complete search history.

(56) References Cited

U.S. PATENT DOCUMENTS

| | | | | |
|---|---|---|---|---|
| 3,137,435 | A | 6/1964 | Myers | |
| 3,215,332 | A | 11/1965 | Bess | |
| 3,332,600 | A * | 7/1967 | Guernsey | 229/125.125 |

(Continued)

FOREIGN PATENT DOCUMENTS

| | | |
|---|---|---|
| DE | 3440853 | 5/1985 |
| DE | 29921100 | 4/2000 |

(Continued)

*Primary Examiner* — Steven A. Reynolds
*Assistant Examiner* — King M Chu
(74) *Attorney, Agent, or Firm* — MeadWestvaco Intellectual Property Group

(57) ABSTRACT

A slide card for selective insertion and withdrawal from a sleeve includes a base panel, a locking panel and at least one embossment. The locking panel is integrally formed with the base panel and hingedly connected to one of the opposing end edges of the base panel to engage at least part of the sleeve to lock the base panel in the sleeve. The locking panel extends from the one of the opposing end edges of the base panel to its free end edge that is located opposed to the one of the opposing end edges of the base panel. The at least one embossment is formed on one of the opposed surfaces of the base panel. The at least one embossment projects from the one of the opposed surfaces of the base panel and is spaced apart from receiving blisters on the base panel.

17 Claims, 2 Drawing Sheets

(56) References Cited

U.S. PATENT DOCUMENTS

| | | | | | |
|---|---|---|---|---|---|
| 3,381,808 | A | | 5/1968 | McGraw, II | |
| 3,659,706 | A | | 5/1972 | Serrell | |
| 3,888,350 | A | | 6/1975 | Horvath | |
| 3,987,891 | A | | 10/1976 | Horvath | |
| 4,007,828 | A | | 2/1977 | Mayled | |
| 4,101,761 | A | | 7/1978 | Merryman | |
| 4,113,098 | A | | 9/1978 | Howard | |
| 4,126,224 | A | | 11/1978 | Laauwe et al. | |
| 4,154,113 | A | | 5/1979 | Engeler | |
| 4,192,422 | A | | 3/1980 | Kotyuk | |
| 4,340,141 | A | * | 7/1982 | Fischer | 206/531 |
| 4,364,488 | A | | 12/1982 | Anjou | |
| 4,401,210 | A | | 8/1983 | Anjou | |
| 4,454,704 | A | | 6/1984 | Ullman | |
| 4,623,062 | A | | 11/1986 | Chase et al. | |
| 4,817,819 | A | | 4/1989 | Kelly | |
| 4,889,236 | A | | 12/1989 | Bartell et al. | |
| 4,940,016 | A | | 7/1990 | Heath | |
| 5,115,416 | A | | 5/1992 | Gehlbach et al. | |
| 5,275,291 | A | | 1/1994 | Sledge | |
| 5,310,060 | A | * | 5/1994 | Bitner et al. | 206/532 |
| 5,549,204 | A | * | 8/1996 | Toren | 206/539 |
| RE35,445 | E | | 2/1997 | Pora | |
| 5,799,675 | A | | 9/1998 | Gunderman et al. | |
| 5,873,466 | A | * | 2/1999 | Hulick | 206/531 |
| 5,954,202 | A | | 9/1999 | Mellon | |
| 5,954,204 | A | | 9/1999 | Grabowski | |
| 6,024,222 | A | | 2/2000 | Friberg et al. | |
| 6,047,829 | A | * | 4/2000 | Johnstone et al. | 206/531 |
| 6,082,544 | A | | 7/2000 | Romick | |
| 6,112,978 | A | | 9/2000 | Barr et al. | |
| 6,230,893 | B1 | | 5/2001 | Karow | |
| 6,349,831 | B1 | | 2/2002 | Buss | |
| 6,412,636 | B1 | | 7/2002 | Jones et al. | |
| 6,491,211 | B1 | * | 12/2002 | Evans et al. | 229/102 |
| 6,641,031 | B2 | | 11/2003 | Evans et al. | |
| 6,752,272 | B2 | | 6/2004 | Jones et al. | |
| 6,874,636 | B2 | * | 4/2005 | Paliotta et al. | 206/531 |
| 7,377,394 | B2 | | 5/2008 | Buss | |
| 7,389,875 | B2 | | 6/2008 | Sandberg et al. | |
| 7,611,027 | B2 | | 11/2009 | Kim | |
| 7,798,328 | B2 | * | 9/2010 | Hession | 206/531 |
| 8,132,671 | B2 | * | 3/2012 | Hession | 206/470 |
| 2003/0047482 | A1 | | 3/2003 | Jones et al. | |
| 2004/0035740 | A1 | | 2/2004 | Paliotta et al. | |
| 2004/0050748 | A1 | | 3/2004 | Ehrlund | |
| 2004/0188311 | A1 | * | 9/2004 | Paliotta et al. | 206/531 |
| 2009/0301924 | A1 | * | 12/2009 | Rondeau | 206/531 |

FOREIGN PATENT DOCUMENTS

| | | | | | |
|---|---|---|---|---|---|
| DE | 20105928 | | | 8/2001 | |
| EP | 1002744 | | | 5/2000 | |
| EP | 1293436 | | | 8/2005 | |
| EP | 1652781 | | | 5/2006 | |
| FR | 2816916 | | | 5/2002 | |
| GB | 1325802 | | | 8/1973 | |
| JP | 200085744 | | | 3/2000 | |
| JP | 200381334 | | | 3/2003 | |
| WO | WO0128865 | | | 4/2001 | |
| WO | WO0238454 | | | 5/2002 | |
| WO | WO03097331 | | | 11/2003 | |
| WO | WO2004019854 | | | 3/2004 | |
| WO | WO2004103255 | | | 12/2004 | |
| WO | WO2005021395 | | | 3/2005 | |
| WO | WO 2005021395 | A1 | * | 3/2005 | B65D 41/32 |
| WO | WO2005051801 | | | 6/2005 | |
| WO | WO2006042181 | | | 4/2006 | |
| WO | WO2007021788 | | | 2/2007 | |
| WO | WO2007140328 | | | 12/2007 | |

* cited by examiner

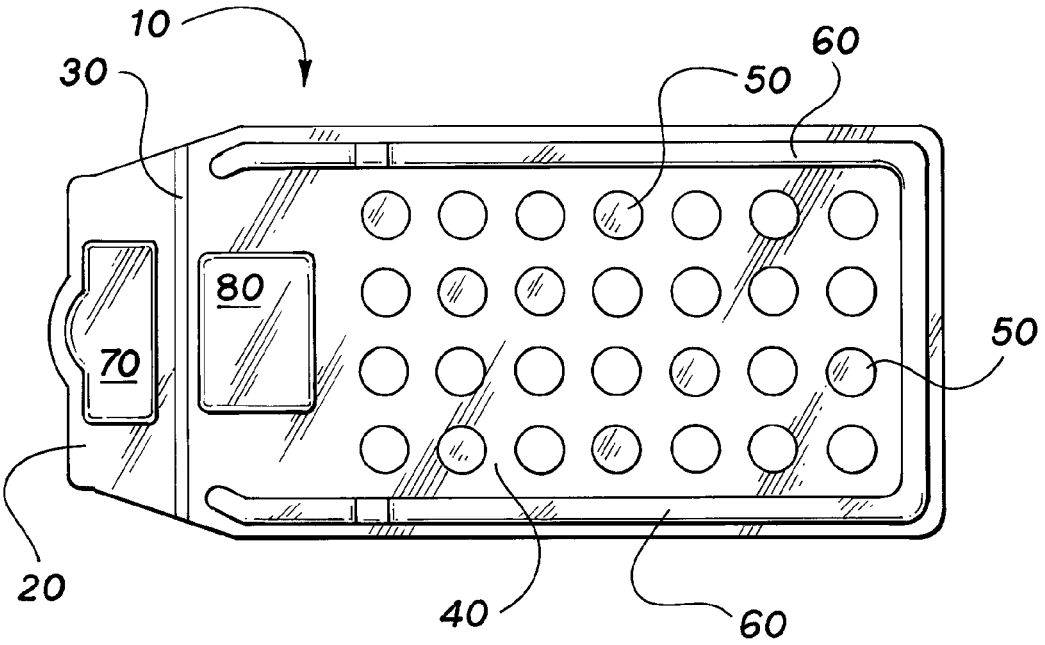
Fig_1
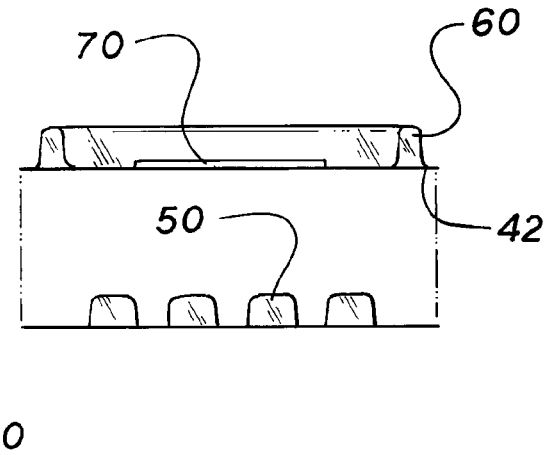
Fig_1A
Fig_2
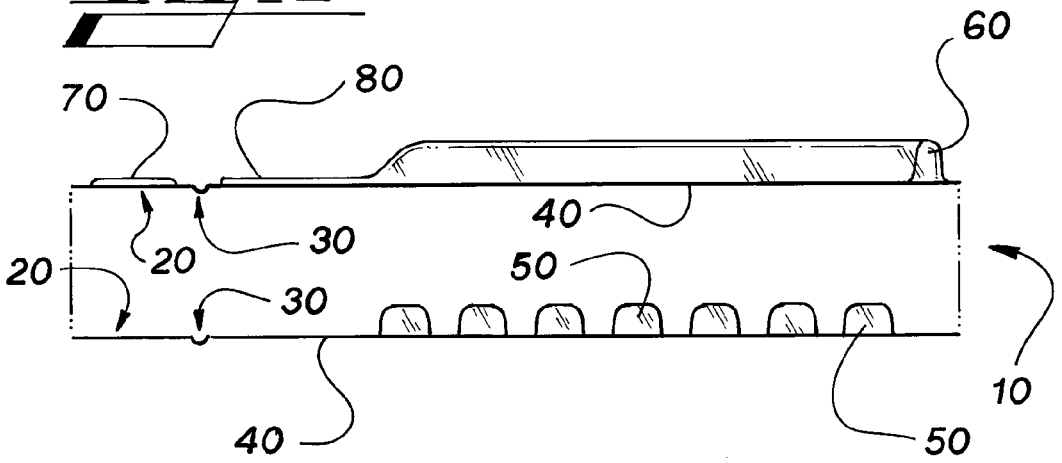

SLIDE CARD FOR SELECTIVE INSERTION AND WITHDRAWAL FROM A SLEEVE

RELATED APPLICATIONS

This application is a continuation of U.S. application Ser. No. 13/412,993, filed Mar. 6, 2012, which is a continuation of U.S. application Ser. No. 11/576,958, filed Nov. 26, 2007, which is a National Phase application of PCT Application No. PCT/US05/036312, filed Oct. 11, 2005, which claims the benefit of U.S. Provisional Application No. 60/617,982, filed Oct. 11, 2004, each of which are incorporated herein by reference in their entirety.

FIELD OF THE INVENTION

This invention relates to unit dose packaging systems, and more particularly to an improved slide card having blisters integrally formed therewith and elements for enhancing performance of a locking panel of the slide card.

BACKGROUND OF THE INVENTION

Unit dose packaging systems are useful as a means for dispensing individual, or unit, dose of a medicament. Such systems are even more useful when they have the added features of providing resistance to the package being opened by a child while at the same time facilitating ease of opening, closing and general use by older individuals whose manual dexterity may have decreased with age. These two attributes are typically referred to as packages, or systems, that are "child-resistant" and "senior-friendly," respectively.

The MeadWestvaco Corporation, or one of its predecessor entities, owns patents issued in the United States that disclose unit dose packaging systems that possess child-resistant and senior-friendly characteristics. MeadWestvaco Corporation, the owner of the present application, is the owner of U.S. Pat. No. 6,047,829, No. 6,230,893, No. 6,412,636 and No. 6,752,272, which disclose unit dose packaging systems. The specifications and teachings of those four patents are hereby incorporated by reference.

U.S. Pat. No. 6,047,829 discloses a unit dose packaging system having a slide card that is received within a shell. The insertable inner slide card is formed from side panels and side panel extensions, both of symmetric construction, that are folded over upon one another to form the slide card. One set of the symmetric side panels contain conventional unit dose packaging holes for receiving respective unit dose blisters. The symmetric equivalents of these panels contain perforated areas corresponding to the holes for permitting removal of respective unit doses. The side panel extensions are disposed at one end of and extend longitudinally from the side panel portions to form an extension to form a panel that will be a part of the systems locking arrangement. The extension is folded over onto the side panel portion to be in condition to engage two separate locking mechanisms. In both locking arrangements, the leading edge of the extension engages an edge and/or opening in the sleeve or shell in a manner that inhibits withdrawal of the insert card until desired. One locking mechanism is positioned at a posterior end of the sleeve/shell to maintain the insert in place fully inserted in the sleeve/shell. A release mechanism can be depressed to lower and disengage the extension, thereby allowing the insert to be withdrawn. A second locking mechanism is formed by folded panels disposed at the anterior end of the sleeve, which is the opening. The folded panel or panels provide a stopping mechanism upon which the extension catches to prevent the insert card from being completely withdrawn.

U.S. Pat. No. 6,230,893 discloses an improvement in the sleeve/shell of a cut-out and node to facilitate use of a first locking mechanism that fully retains the insert within the sleeve/shell.

U.S. Pat. No. 6,412,636 discloses a unit dose packaging system wherein the outer sleeve includes offset notches for grasping and removing an internal slide card and the outer sleeve is at least partially laminated with a polymeric film.

U.S. Pat. No. 6,752,272 discloses a unit dose package having a pocket foldable extending from the sleeve.

Preventing or inhibiting undesired partial or full removal of the inner slide card from the sleeve/shell is important in helping facilitate resistance to child tampering and use by seniors. Thus, it will be appreciated that it is useful to have a unit dose package that enhances the operation of features that prevent or inhibit the undesired removal of the inner card from the sleeve/shell.

Because cost of manufacturing is an important factor in the production of any product, it will likewise be appreciated that it is desirable to have a unit dose package that is efficient to operate, is durable and sturdy, and simple to construct thereby reducing the cost of manufacture.

SUMMARY OF THE INVENTION

The present invention provides a unit dose packaging system having an inner slide card that is simple and more cost effective to manufacture. The slide card of the system also provides enhanced features for preventing or inhibiting undesired removal of the slide card from a sleeve or shell of the system.

In a preferred embodiment of one aspect of the invention, a slide card for use with a sleeve of a unit dose packaging system has at least one blister integrally formed with the base panel of the slide card for receiving a unit dose of a medicament.

In a preferred embodiment of a second aspect of the invention, a slide card for use with a sleeve or shell of a unit dose packaging system has at least one fold-resisting mechanism for inhibiting substantially parallel alignment between a base panel and a locking panel of the slide card.

In another preferred embodiment of the second aspect of the invention, the fold-resisting mechanism is a hinge that connects the base panel and locking panel adapted for biasing the base panel and the locking panel away from one another.

In accordance with a further preferred embodiment of the second aspect of the invention, at least one of a base panel and a locking panel of the slide card has at least one fold-resisting abutment as the fold-resisting mechanism.

In accordance with still a further preferred embodiment of the second aspect of the invention, the base panel and the locking panel each have at least one fold-resisting abutment.

In accordance with an additional preferred embodiment of the second aspect of the invention, a fold-resisting abutment on the base panel and a fold-resisting abutment on the locking panel are disposed for engagement with one another.

In accordance with still an additional preferred embodiment of the invention, the fold-resisting abutment is an embossment.

In a final preferred embodiment of the invention, the slide card including base panel and locking panel are formed from plastic.

BRIEF DESCRIPTION OF THE DRAWINGS

FIG. 1 is a top plan view a slide card in accordance with an embodiment of the invention.

FIG. 1*a* is an elevation view from an anterior end of the slide card of FIG. 1.

FIG. 2 is a side elevation view of the slide card of FIG. 1.

DETAILED DESCRIPTION OF THE INVENTION

Figure 3:
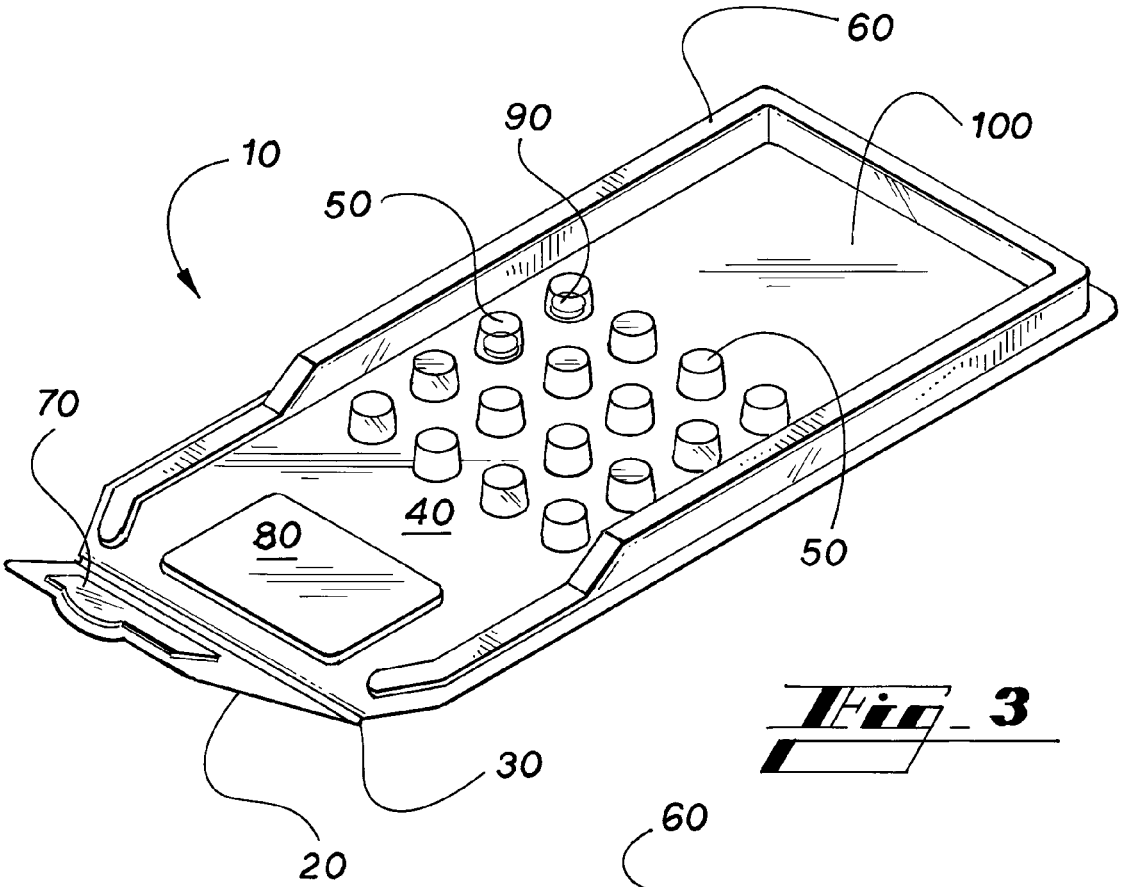
FIG. 3 is a perspective view of the slide card of FIG. 1 showing the locking panel partially pivoted with respect to the base panel.

As required, detailed embodiments of the present invention are disclosed herein. It must be understood that the disclosed embodiments are merely exemplary of the invention that may be embodied in various and alternative forms, and combinations thereof. The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring first to FIG. 1, therein is illustrated a slide card in accordance with a preferred embodiment of the invention. A slide card 10 has a base panel 40 and a locking panel 20 hingedly 30 connected. The base panel has blisters 50 for holding a medicament. A rib 60 extends around the perimeter of the base panel 40. The locking panel 20 has a fold-resisting abutment 70 and base panel 40 has a fold-resisting abutment 80 proximate the hinge 30 and adjoining locking panel.

Referring now to FIG. 1*a*, therein is illustrated a slide card 10 in an elevation view from an anterior vantage point. One aspect of the invention is directed primarily to the fold-resisting abutments 70, 80. In the plan view of FIG. 1, the slide card 10 would appear the same irrespective of whether the slide card would be integrally formed with blisters or having a separate blister pack joined to the slide card. FIG. 1*a* illustrates the manner in which the card 10 would be formed from composite slide and blister cards but still maintain, the fold-resisting abutment features. The combination of the rib(s) 60 rising above the surface of the base panel 40 creates a flange 42 element.

Referring now to the side elevation view of the slide card 10 in FIG. 2, the alignment and relative disposition of fold-resisting abutments 70, 80 with respect to one another can be seen. As in FIG. 1*a*, the option of forming the card from composite slide and blister cards as opposed to an integrated card is shown. In this side view, the hinge 30 is shown with the possibility of being formed in the "reverse" of the other elements, namely, the fold-resisting abutments 70, 80 and rib 60. If the card 10 is made of plastic material and some types of paper substrates, it can be formed by manufacturing processes such as thermo-forming or die-press with a tool set. An integrated slide and blister card as taught by the invention is simple and can be simply formed by these processes, particularly when the card is made of plastic substrate. The term "reverse" for the hinge 30 refers to the fact that the hinge as illustrated is formed in a downward direction, opposite the direction in which the abutments 70, 80 and rib(s) 60 are formed. Although shown in is reverse form, the hinge may be suitably formed in the same upward direction as the other elements on the card. The hinge 30 may be formed in any configuration by known substrate manufacturing methods including but not limited to perforation along a line that will form the hinge and creasing.

Referring now to FIG. 3, the slide card 10 of FIGS. 1, 1*a* or 2 is shown in perspective view. The locking panel 20 is shown partially pivoted about the hinge 30 with respect to the base panel 40. In using the slide card 10, medicaments 90 are contained within the blisters 50. A substrate such as foil or some type of composite substrate containing foil, generally indicated but not shown, holds the medicaments 90 in place within the blisters 50 until removed by known methods.

Figure 4:
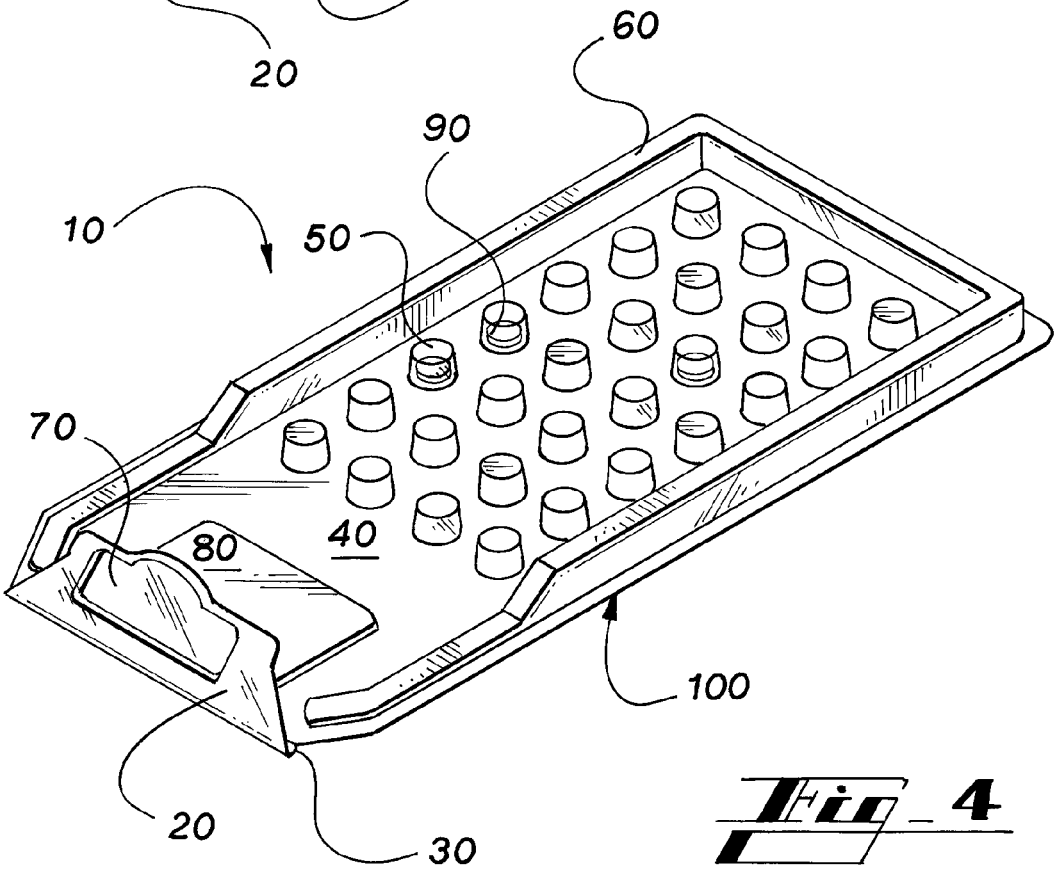
FIG. 4 is a perspective view of the slide card of FIG. 1 with the locking panel more fully pivoted with respect to the base panel but at an angle wherein the slide card would be inserted within a sleeve or shell and the locking panel disposed for engagement by one or more locks of the sleeve/shell.

Referring finally to FIG. 4, the slide card 10 is shown as illustrated in FIG. 3 with the locking panel 20 further pivoted to a position wherein it would engage one or more locks in a sleeve or shell to help form a locking arrangement as shown in the prior art discussed herein.

In one aspect of the invention, as shown in the embodiment illustrated in FIGS. 1, 3 and 4, the slide card 10 has unit dose blister 50 that are integrally formed with the base panel.

In another aspect of the invention, the ability of the locking panel 20 to be engaged by an aperture or panel that forms a part of the locking arrangement of the system's sleeve or shell is enhanced by biasing the locking panel away from a substantially parallel condition with respect to the base panel 40. A fold-resisting mechanism serves this purpose. The hinge 30 serves as a fold-resisting mechanism to bias the locking panel. The amount of bias in the hinge 30 may be controlled by manufacturing techniques such as varying the thickness of the hinge 30 or otherwise varying the degree to which a line forming the hinge 30 is weakened to permit bending. An abutment 70, 80 may serve as an additional or distinct fold-resisting mechanism or element. The abutment 70, 80 prevents the locking panel 20 and base panel 40 from being placed into a substantially parallel condition with respect to one another. Although one abutment 70, 80 on either of the locking panel 20 and the base panel 40 is sufficient to serve as a fold-resisting mechanism or element, more than one be used on either one or both panels. The use of opposing abutments 70, 80 on respective locking 20 and base 40 panels, provides the advantage of being able to minimize the height of each abutment while still achieving desirable fold resistance. Although the abutment may be take many forms, an embossed abutment may be easily manufactured in a substrate, particularly a slide card substrate of plastic. Although paper may be used as a substrate, plastic may be easily thermoformed, die-pressed or otherwise easily manipulated.

It must be emphasized that the law does not require and it is economically prohibitive to illustrate and teach every possible embodiment of the present claims. Hence, the above-described embodiments are merely exemplary illustrations of implementations set forth for a clean understanding of the principles of the invention. Variations, modifications, and combinations may be made to the above-described embodiments without departing from the scope of the claims. All such variations, modifications, and combinations are included herein by the scope of this disclosure and the following claims.

The invention claimed is:

1. A slide card for selective insertion and withdrawal from a sleeve, the slide card comprising:

a base panel having a pair of opposing end edges, the base panel having a hinge formed by a single weakened line, the hinge extending along one of the end edges, the other of the end edges being free of connection to any other part of the slide card, the base panel having a first surface extending between the end edges, the base panel having at least one receiving blister integrally formed therewith, the first surface of the base panel including a first region where none of the at least one receiving blister is located and a second region where the at least one receiving blister is located, the first region extending between the second region and the one of the end edges;

a locking panel integrally formed with the base panel, the locking panel being hingedly connected directly to the one of the end edges of the base panel along the hinge to engage at least part of the sleeve to lock the base panel in the sleeve, the locking panel being folded about the hinge to take a folded position where the locking panel is disposed at a first angle with respect to the base panel such that the locking panel and the base panel are prevented from being placed into a substantially parallel condition with respect to one another, the locking panel extending from the one of the end edges of the base panel to a free end edge of the locking panel, the free end edge being disposed opposed to the one of the end edges of the base panel; and at least one first embossment projecting from the first region of the base panel and being spaced apart from the at least one receiving blister; and wherein the locking panel is disposed over the at least one first embossment when the locking panel is folded to the folded position.

2. The slide card of claim 1, further comprising at least one second embossment projecting from one of first and second opposed surfaces of the locking panel, the at least one second embossment being spaced apart from the free end edge of the locking panel and being disposed over the first region when the locking panel is in the folded position.

3. The slide card of claim 2, wherein the at least one first embossment is substantially different in shape from the at least one second embossment.

4. The slide card of claim 2, wherein the at least one first embossment is spaced apart from the at least one second embossment.

5. The slide card of claim 2, wherein the at least one second embossment is disposed over the at least one first embossment when the locking panel is in the folded position.

6. The slide card of claim 1, wherein the at least one first embossment comprises at least one raised area of the first surface of the base panel and having no contents.

7. The slide card of claim 6, wherein the at least one raised area is disposed out of a plane of the first surface of the base panel.

8. The slide card of claim 2, wherein the at least one second embossment is substantially different in shape from the at least one receiving blister.

9. The slide card of claim 1, wherein the at least one first embossment is substantially different in shape from the at least one receiving blister.

10. The slide card of claim 2, wherein the locking flap has an outline, the free end edge comprises one section of the outline that is located furthermost from the one of the end edges of the base panel among all sections of the outline, and the at least one second embossment is spaced apart from the one section.

11. The slide card of claim 10, wherein the outline includes at least one straight section extending directly from the one section, and the at least one second embossment is spaced apart from the at least one straight section.

12. The slide card of claim 2, wherein the locking panel is defined by a perimeter that includes the free end edge and the one of the end edges of the base panel, and the at least one second embossment is spaced apart from any part of the perimeter.

13. The slide card of claim 2, wherein the one of the first and second surfaces of the locking panel includes at least one embossed area covered by the at least one second embossment and at least one flat area where none of the at least one second embossment is provided, the at least one second embossment is entirely surround by the at least one flat area.

14. The slide card of claim 2, wherein the free end edge includes a peak that is located at a greater distance from the one of the end edges of the base panel than any other part of the locking panel, and the at least one second embossment is spaced apart from the peak.

15. The slide card of claim 14, wherein the peak is rounded.

16. The slide card of claim 2, wherein the locking panel has a pair of opposed side edges each extending between the free end edge and the one of the opposing end edges of the base panel, and said at least one second embossment is spaced apart from both the side edges of the locking panel.

17. The slide card of claim 1, wherein the locking panel is disposed over none of the at least one receiving blister when the locking panel is folded over the base panel.

* * * * *